US009827506B2

(12) United States Patent
Mosher et al.

(10) Patent No.: US 9,827,506 B2
(45) Date of Patent: Nov. 28, 2017

(54) MODEL VEHICLE WITH MECHANICAL LOAD

(71) Applicants: Richard J Mosher, Memphis, MI (US); Jon F. Zahornacky, Santa Clara, CA (US); Robert M. Bosman, Richmond, MI (US)

(72) Inventors: Richard J Mosher, Memphis, MI (US); Jon F. Zahornacky, Santa Clara, CA (US); Robert M. Bosman, Richmond, MI (US)

(73) Assignee: Lionel LLC, Concord, NC (US)

( * ) Notice: Subject to any disclaimer, the term of this patent is extended or adjusted under 35 U.S.C. 154(b) by 0 days.

(21) Appl. No.: 14/670,759

(22) Filed: Mar. 27, 2015

(65) Prior Publication Data

US 2016/0279532 A1 Sep. 29, 2016

(51) Int. Cl.

| | |
|---|---|
| ***A63H 19/02*** | (2006.01) |
| ***A63H 19/15*** | (2006.01) |
| ***A63H 19/14*** | (2006.01) |

(52) U.S. Cl.

CPC ..... *A63H 19/15* (2013.01); *A63H 19/14* (2013.01)

(58) Field of Classification Search

CPC ..... A63H 19/24; A63H 19/14; A63H 19/15; A63H 30/02; A63H 33/3044

See application file for complete search history.

(56) References Cited

U.S. PATENT DOCUMENTS

| | | | | | |
|---|---|---|---|---|---|
| 2,305,491 | A * | 12/1942 | Pettit | A63H 19/15 | 104/296 |
| 2,373,271 | A * | 4/1945 | Smith | A63H 33/3044 | 212/87 |
| 2,799,119 | A * | 7/1957 | Bonanno | A63H 19/00 | 446/428 |
| 2,949,695 | A * | 8/1960 | Zion | A63H 19/15 | 105/238.2 |
| 3,466,797 | A * | 9/1969 | Hellsund | A63H 19/14 | 446/410 |
| 3,664,060 | A * | 5/1972 | Longnecker | G10K 15/02 | 446/410 |
| 3,839,822 | A * | 10/1974 | Rexford | A63H 19/14 | 446/410 |
| 4,100,696 | A * | 7/1978 | Ogasawara | A63H 18/14 | 446/236 |
| 5,803,411 | A * | 9/1998 | Ackerman | B61L 3/00 | 246/169 R |

(Continued)

*Primary Examiner* — Melba Bumgarner
*Assistant Examiner* — Amir Klayman
(74) *Attorney, Agent, or Firm* — Fitzsimmons IP Law

(57) ABSTRACT

A system and method is provided for monitoring and controlling a load disposed at least partially within a model vehicle. Preferred embodiments of the present invention operate in accordance with a load car that includes a load, a motor, and a controller for operating the motor to raise and lower the load. In one embodiment, the controller is configured to monitor at least one metric (e.g., a coal level) and to operate the motor so that the vertical position of the load (e.g., a coal load) is synchronized to the metric. If the metric goes up, then the load is moved (e.g., via the motor) in an upward direction. Alternatively, if the metric goes down, then the load is moved (e.g., via the motor) in a downward direction.

20 Claims, 6 Drawing Sheets

(56) References Cited

U.S. PATENT DOCUMENTS

| | | | | | |
|---|---|---|---|---|---|
| 5,821,406 | A * | 10/1998 | Ridgeway | B67D 7/04 | 73/53.05 |
| 5,855,004 | A * | 12/1998 | Novosel | A63H 19/14 | 105/1.5 |
| 6,457,681 | B1 * | 10/2002 | Wolf | A63H 19/14 | 104/296 |
| 7,430,491 | B2 * | 9/2008 | Gutierrez | G01G 19/08 | 177/1 |
| 7,770,847 | B1 * | 8/2010 | Severson | A63H 19/24 | 246/1 C |
| 8,154,227 | B1 * | 4/2012 | Young | A63H 19/24 | 318/255 |
| 2009/0020076 | A1 * | 1/2009 | Ghiraldi | A01K 5/02 | 119/57.92 |
| 2013/0239676 | A1 * | 9/2013 | Sunesson | G01F 23/284 | 73/290 V |
| 2014/0360399 | A1 * | 12/2014 | Rees | A63H 19/24 | 104/295 |

* cited by examiner

MODEL VEHICLE WITH MECHANICAL LOAD

BACKGROUND OF THE INVENTION

1. Field of the Invention

The present invention relates to model vehicles, or more particularly, to a system and method for monitoring and/or controlling a load disposed on a model vehicle.

2. Description of Related Art

For millions of consumers, operating a model device, such as a model train, is a form of entertainment. However, for these consumers, much of the entertainment lies in the realism of the device. Thus, for model train enthusiasts, the model train should appear and operate as close to an actual train as possible. Thus, not only should the model train look like an actual train, but it should also function like an actual train.

In traditional model vehicles, realistic functionality has been achieved by generating realistic sounds, and synchronizing the sounds to particular actions. For example, a model train having a smoke stack may generate chuffing sounds as smoke is expelled (or puffed) from the smoke stack. By way of another example, Lionel™ has manufactured a model train that monitors and displays various train metrics. A processor within the train displays (e.g., via a remote control, a computing device (e.g., laptop, smart phone, etc.) operating a remote control application or program, etc.) various metrics, such as fuel level, etc. These metrics are then adjusted based on operating conditions of the train. Thus, even though the model train is electric, and contains no actual fuel, the processor calculates a fuel level (or changes thereto) based on certain operating characteristics, such as train speed, train load, etc. As the fuel level changes, a fuel level gauge (e.g., on the remote control, etc.) is accordingly updated, allowing a user to know when it is time to pull the train into a fuel station in order to "refuel." Such features are described in greater detail in U.S. patent application Ser. Nos. 14/525,177 and 14/559,599, which are incorporated herein, in their entirety, by reference.

While providing a user with information regarding a metric provides a more realistic experience, it is limited in that the metric is fictional, and does not actually exist on the model vehicle. For example, while a processor can keep track of and display a fuel level for a model vehicle, there is no actual fuel in the model vehicle. This is because most model vehicles run on electricity.

Thus, in order to provide a more realistic experience, it would be advantageous to not only display a metric for a model vehicle, but also simulate the metric and changes thereto on the model vehicle. This would allow the user to not only view information on the metric (e.g., via a remote control, etc.), but to see evidence of the metric, including changes thereto, on the model vehicle. In a preferred embodiment, the metric is a load (e.g., a coal load, etc.) disposed on and/or in the vehicle, and the system is configured to monitor the virtual load (e.g., as stored in a memory) and to synchronize the actual load (e.g., simulated coal load) to the virtual load by mechanically controlling the actual load.

SUMMARY OF THE INVENTION

The present invention provides a system and method for monitoring and controlling a load disposed at least partially within a model vehicle. Preferred embodiments of the present invention operate in accordance with a load car that includes a load, a motor, and a controller for operating the motor to raise and lower the load.

In a preferred embodiment of the present invention, the model train system includes at least one coal load disposed at least partially within at least one coal car. For example, the model train system may include a model train track, a plurality of model train cars operating on the model train track, and a transceiver configured to communicate with a model train remote control. The plurality of model train cars may include a first car (e.g., an engine, etc.) and a second car (e.g., a coal car, etc.), where the first car is configured to communicate with the second car (e.g., via a wired connection, infrared, etc.) and/or the remote control via the transceiver.

The coal car may include a chassis and a coal load disposed at least partially within the chassis. In one embodiment, the chassis, which is configured to operate on the model train track, includes at least one cavity, and the coal load, which includes at least an upper surface and a lower surface, is at least partially disposed within the cavity. In accordance with this embodiment, the coal car also includes a motor, a controller, a line (e.g., rope, string, wire, cable, etc.), and at least one spring, where a first end of the line is connected to the motor (or a spool portion thereof), and a second end of the line is connected to the bottom of the coal load, and the controller is in communication with, and is configured to operate, the motor (e.g., in forward and reverse directions).

When the controller operates the motor in a first (or forward) direction, the motor pulls the coal load (via the line) in a downward direction. This can be accomplished by operating a gear within the motor over a gear track, which results in wrapping the line over a spool. When the controller operates the motor in a second (or reverse) direction, the motor allows the coal load to move in an upward direction. This is achieved by letting out (or releasing) the line, and allowing the spring(s) to move the coal load in an upward direction. In other words, by operating the motor in the second direction, the line is released from the spool (not shown), and the spring(s) bias the coal load in an upward direction.

In one embodiment of the present invention, the controller is configured to monitor at least one metric (e.g., a coal level, etc.) and to operate the motor so that the vertical position of the coal load is synchronized to the virtual coal level (e.g., as stored in memory and displayed to a user). For example, if the virtual coal level is full, then the coal load is moved (e.g., via the motor, springs, line, etc.) to an upper position. Alternatively, if the virtual coal level is empty (or relatively low), then the coal load is moved (e.g., via the motor, line, etc.) to a lower position.

In one embodiment of the present invention, the coal load includes a shell (e.g., a molded plastic shell, etc.), and at least one spring having a length that is greater than a length of the shell. By using a longer spring, the spring will project upward when it is attached to the shell, forcing the simulated coal to appear raised in the center. In one embodiment, the simulated coal comprises a rubber sheet that has been sprayed with a black, pebble-like material (e.g., a black-pebble like material that is attached to the rubber sheet via an adhesive, etc.). When the components are assembled, the spring will make the simulated coal appear "mounded," as actual coal would appear after being dumped into a coal car.

In another embodiment of the present invention, the load car is configured to generate sounds that are associated with the increasing and/or decreasing of the load. In another embodiment, the coal car further include at least one safety mechanism to prevent the motor from moving the load beyond an upper and/or lower limit. The safety mechanism may include (i) at least one switch and/or (ii) a clutch. If the switch is triggered, indicating that the coal load has reached its upper or lower limit, the processor (not shown) may either turn the motor off, or engage the clutch, which allows the motor to operate without further moving the load.

A more complete understanding of a system and method for monitoring and/or controlling a load disposed on a model train will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for monitoring and controlling a load disposed at least partially within a model vehicle. In the detailed description that follows, like element numerals are used to describe like elements illustrated in one or more figures. It should be appreciated that while the present invention is described herein in terms of a model train system that includes a coal car, the invention is not so limited. For example, the invention could be used to monitor and/or control any load (e.g., water, fuel, etc.) in any model vehicle (e.g., model boat, helicopter, etc.).

Figure 1:
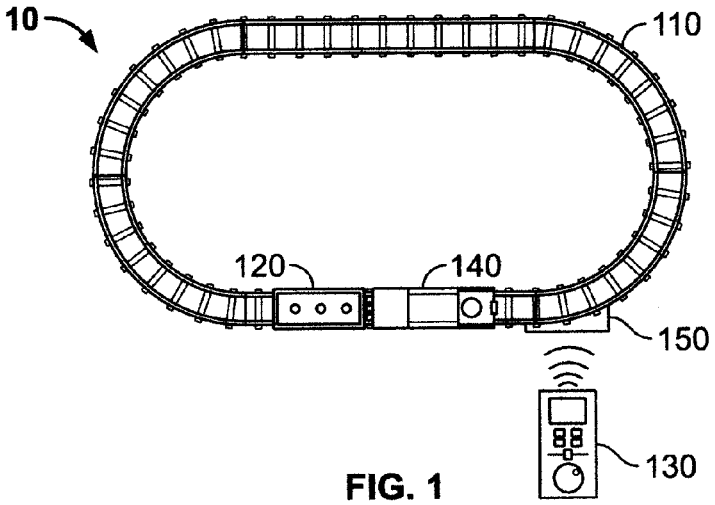
FIG. 1 illustrates a model train system in accordance with one embodiment of the present invention, wherein the model train system includes at least one model train, a model train track, a transceiver, and a remote control.

In a preferred embodiment of the present invention, the model train system includes at least one coal load disposed at least partially within at least one coal car. For example, as shown in FIG. 1, the model train system 10 may include a model train track 110, a plurality of model train cars (120, 140) operating on the model train track 110, and a transceiver 150 configured to communicate with a model train remote control 130. The plurality of model train cars may include a first car 140 (e.g., an engine, etc.) and a second car 120 (e.g., a coal car, etc.), where the first car 140 is configured to communicate with the second car (e.g., via a wired connection, infrared, etc.) and/or the remote control 130 via the transceiver 150. It should be appreciated that the present invention is not limited to the model train system shown in FIG. 1, and may include additional, fewer, and/or different components. For example, the system may include a traditional, dedicated remote control, a laptop (e.g., running a remote control program), a smart phone (e.g., running a remote control application), or any other device configured to control the model train and/or provide data on the model train (e.g., at least one metric, etc.) to the user.

Figure 2:
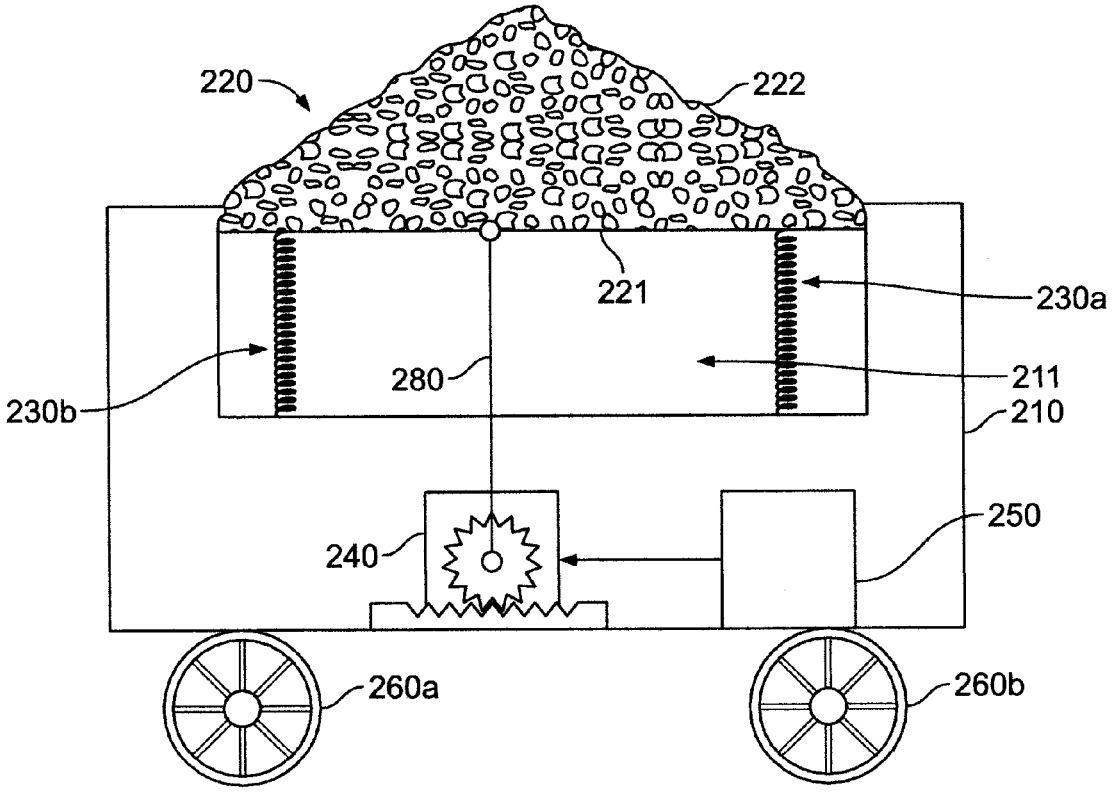
FIG. 2 illustrates a coal car in accordance with one embodiment of the present invention, wherein the coal car includes a coal load, a motor and a controller for operating the motor.

As shown in FIG. 2, the coal car may include a chassis 210 and a coal load 220 disposed at least partially within the chassis 210. In one embodiment, the chassis, which is configured to operate on the model train track (see FIG. 1 at 110) via a plurality of wheels (260*a*, 260*b*) and axles (not shown), includes at least one cavity 211, and the coal load 220, which includes at least an upper surface 222 and a lower surface 221, is at least partially disposed within the cavity 211. In accordance with this embodiment, the coal car also includes a motor 240, a controller 250, a line 280 (e.g., rope, string, wire, cable, etc.), and at least one spring (230*a*, 230*b*), where a first end of the line is connected to the motor 240 (or a spool portion thereof), and a second end of the line is connected to the bottom of the coal load 221, and the controller 250 is in communication with, and is configured to operate, the motor (e.g., in forward and reverse directions).

When the controller 250 operates the motor 240 in a first (or forward) direction, the motor pulls the coal load 220 (via the line 280) in a downward direction. This can be accomplished by operating a gear within the motor 240 over a gear track, which results in wrapping the line 280 over a spool. When the controller 250 operates the motor 240 in a second (or reverse) direction, the motor allows the coal load 220 to move in an upward direction. This is achieved by letting out (or releasing) the line 280, and allowing the spring(s) (230*a*, 230*b*) to move the coal load 230 in an upward direction. In other words, by operating the motor in the second direction, the line 280 is released from the spool (not shown), and the spring(s) (230*a*, 230*b*) bias the coal load 220 in an upward direction.

Figure 3A:
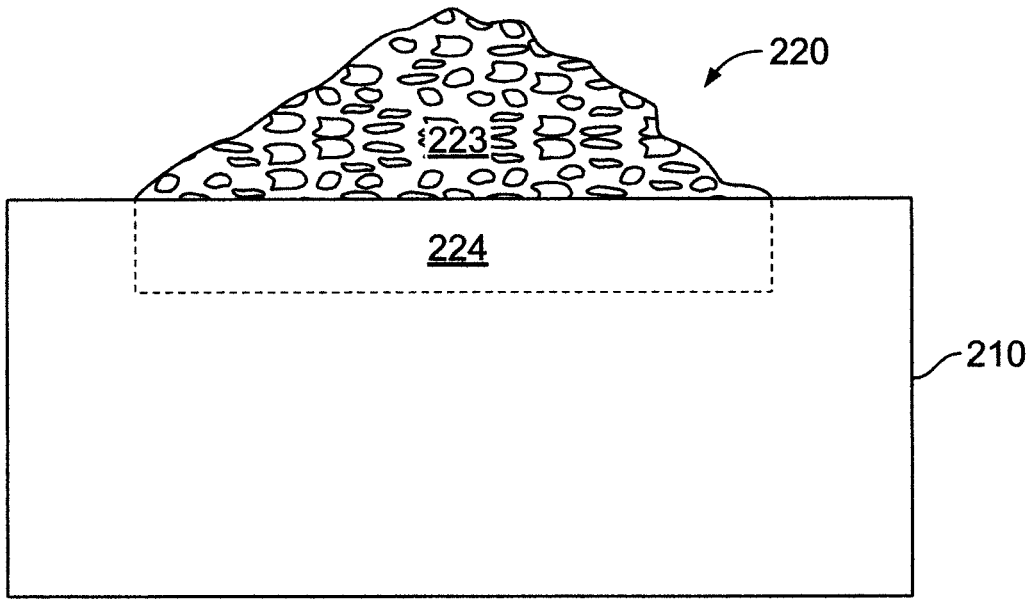
FIG. 3A illustrates the coal load from FIG. 2 in an upper position.
Figure 3B:
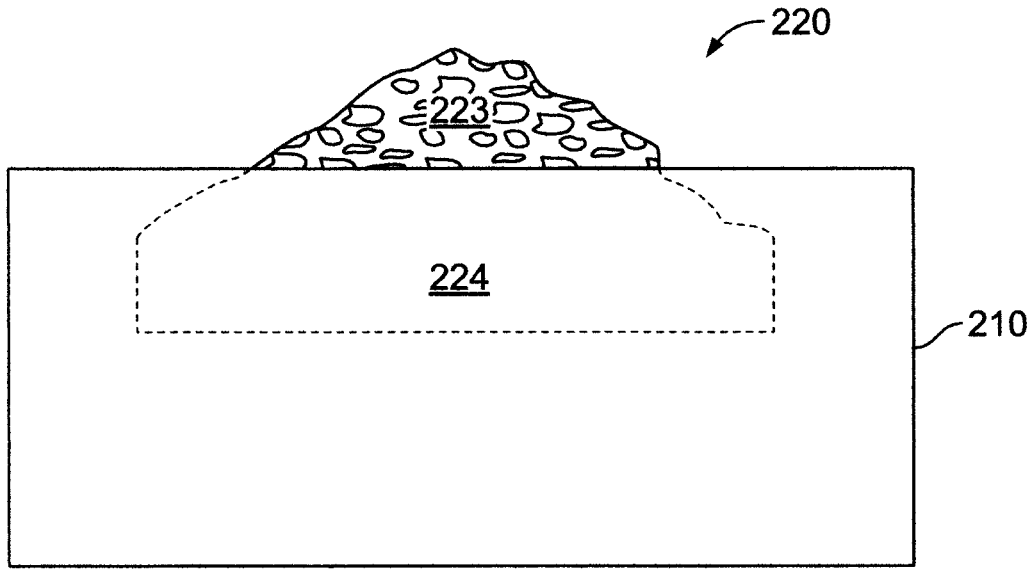
FIG. 3B illustrates the coal load from FIG. 2 in a lower position.

In one embodiment of the present invention, the controller 250 is configured to monitor at least one metric (e.g., a coal level, etc.) (discussed further below) and to operate the motor 240 so that the vertical position of the coal load is synchronized to the virtual coal level (e.g., as stored in memory and displayed to a user). For example, if the virtual coal level is full, then the coal load is moved (e.g., via the motor, springs, line, etc.) to an upper position, as shown in FIG. 3A. Alternatively, if the virtual coal level is empty (or relatively low), then the coal load is moved (e.g., via the motor, line, etc.) to a lower position, as shown in FIG. 3B. In the upper position, a smaller portion of the coal load 224 is disposed within the chassis, and a larger portion of the coal load 223 is visible to the user (see FIG. 3A). In the lower position, a larger portion of the coal load 224 is disposed within the chassis, and a smaller portion of the coal load 223 is visible to the user (see FIG. 3B). It should be appreciated that the present invention is not limited to the coal load shown in FIGS. 3A and 3B. For example, a coal load that is entirely visible to the user (and not disposed within the chassis) when it is in the upper position is within the spirit and scope of the present invention. In yet another example, a coal load that is entirely disposed within the chassis when it is in the lower position is within the spirit and scope of the present invention.

Figure 4:
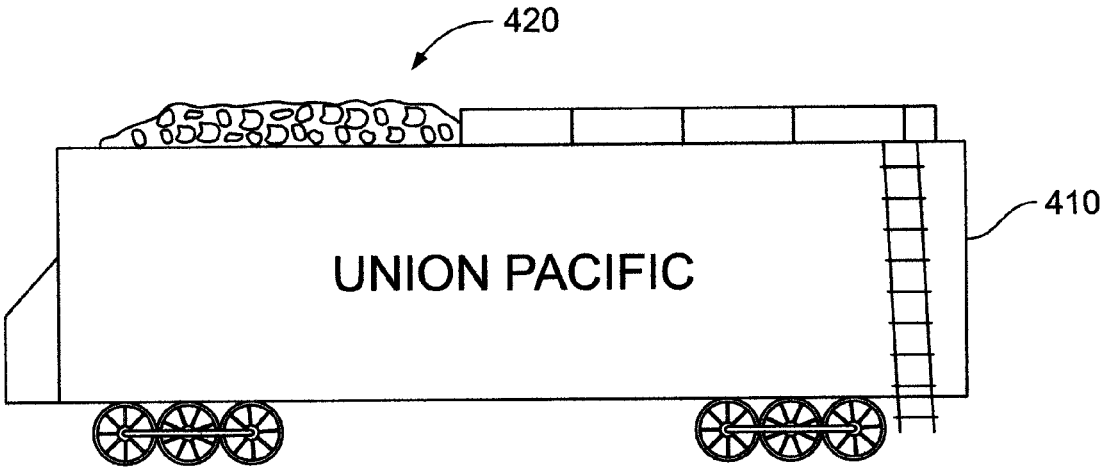
FIG. 4 illustrates a coal car in accordance with another embodiment of the present invention.

It should be appreciated that the present invention is not limited to the coal car shown in FIG. 2, and a coal car that includes fewer, additional, and/or different components is within the spirit and scope of the present invention. For example, a coal car that includes a rigid line (e.g., a metal rod that moves vertically, etc.) and no spring is within the spirit and scope of the present invention. By way of another example, a coal car where the coal load is visible from only a portion of the upper surface of the car, as shown in FIG. 4, is also within the spirit and scope of the present invention.

Figure 5A:
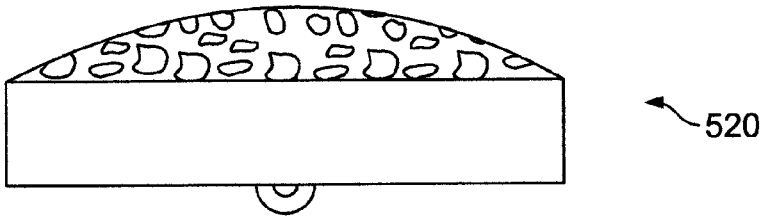
FIG. 5A illustrates the coal load from FIG. 2.
Figure 5B:
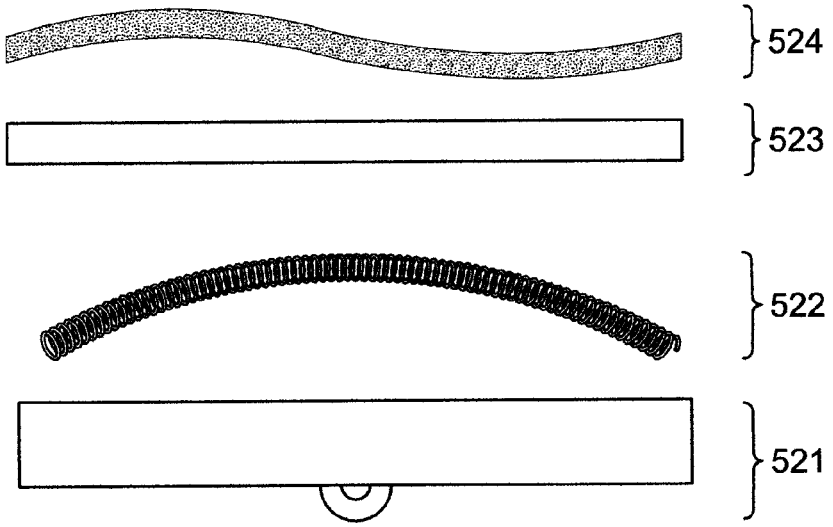
FIG. 5B illustrates a deconstructed view of the coal load from FIG. 2.

One embodiment of the coal load 520 is shown in FIG. 5A, with an exploded view being provided in FIG. 5B. In particular, the coal load 520 may include a shell 521 (e.g., a molded plastic shell, etc.), and at least one spring 522, wherein the spring 522 has a length that is greater than a length of the shell 521. By using a longer spring 522, the spring 522 will project upward (as shown in FIG. 5B) when it is attached to the shell 521, forcing the simulated coal (e.g., 523, 524) to appear "mounded," or raised in the center. In one embodiment, the simulated coal comprises a rubber sheet 522 that has been sprayed with a black, pebble-like material 524 (e.g., a black-pebble like material that is attached to the rubber sheet via an adhesive, etc.). As discussed above, when the components shown in FIG. 5B are assembled, the spring 522 will make the simulated coal (523, 524) appear "mounded," as actual coal would appear after being dumped into a coal car. It should be appreciated that the coal load of the present invention is not limited to the one shown in FIGS. 5A and 5B, and can includes loads made with fewer, additional, or different materials. For example, a container that includes actual coal, or a hard substance that has a coal-like appearance (e.g., black volcano rock, etc.), is within the spirit and scope of the present invention. It should also be appreciated that the load of the present invention is not limited to a coal load, and could be any load that (a) can be carried by a vehicle and (b) needs to be occasionally replenished (e.g., wood, oil, gasoline, diesel, water, etc.). If the load is solid, it can be mechanically moved as described above. However, if the load is liquid, it may need to be secured inside a container that is at least partially transparent. The liquid level can then be adjusted (e.g., made more or less visible to the user) by moving the container up and down, moving a lower surface of the container up and down, or pumping liquid into and out of the container (e.g., via a pump, a piston, etc.). While the actual liquid level in the load car does not change, it appears to the user as if the level is going up/down.

Figure 6:
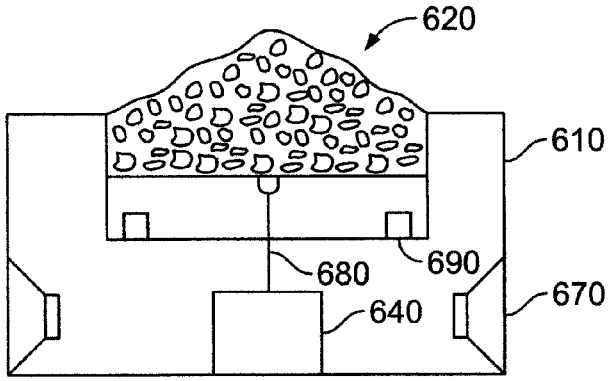
FIG. 6 illustrates a portion of a coal car in accordance with another embodiment of the present invention.

Additional features of the present invention can be seen in FIG. 6. In particular, the load car (or another car (e.g., an engine) or accessory in communication with the load car) is configured to generate sounds that are associated with the increasing and/or decreasing of the load. For example, a processor (not shown) can use at least one speaker 670 to generate a sound of coal being dumped into a coal car when the coal car is being filled. In a preferred embodiment of the present invention, the sound of coal being dumped into the coal car is synchronized with the motor 640 moving the coal load 620 into an upper position.

The coal car may further include at least one safety mechanism to prevent the motor 640 from moving the load 620 beyond an upper and/or lower limit. In one embodiment of the present invention, the safety mechanism includes at least one switch 690, which indicates (e.g., to the processor) that the load 620 has reached its limit. In another embodiment of the present invention, the motor 640 may also (or alternately) include a clutch (not shown) that allows the motor 640 to operate without moving the line 680. For example, if the switch 690 is triggered, indicating that the coal load 620 has reached its upper or lower limit, the processor (not shown) may merely turn the motor 640 off, or engage the clutch (not shown), which allows the motor 640 to operate without further moving the line 680. It should be appreciated that the present invention is not limited to features shown in FIG. 6. For example, a load car with more or less switches (e.g., an upper switch, a lower switch, etc.) and/or remotely located speakers are within the spirit and scope of the present invention.

As discussed in the related U.S. patent application Ser. Nos. 14/525,177 and 14/559,599, a processor is used to monitor at least one metric of the model vehicle. First of all, while the metric described herein is a coal level, it should be appreciated that the present invention is not so limited, and monitoring of other metrics, such as water level, temperature, oil level, gasoline level, etc., is within the spirit and scope of the present invention. Second, because the metric is simulated (since the model vehicle does not consume coal, water, etc.), the coal level will be referred to herein as a "virtual" coal level. Thus, in a preferred embodiment of the present invention, a first processor (e.g., in the engine, etc.) is configured to monitor the virtual coal level of the model train, and a second processor (e.g., in the coal car, etc.) is configured to operate the motor based on the virtual coal level. In an alternate embodiment, a single processor is used to both monitor the virtual coal level and operate the motor.

Figure 7:
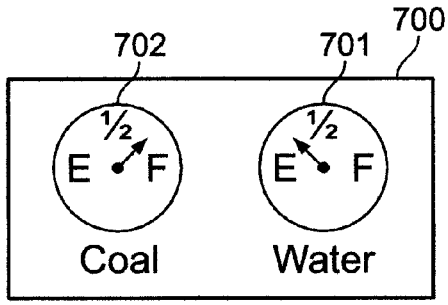
FIG. 7 illustrates at least a portion of the remote control shown in FIG. 1, wherein the remote control displays various metrics of the model train.

To enhance the realism of the model vehicle, at least one metric (as monitored) can be displayed to the user via a display. The display may be part of the model train's remote control, which may be a traditional, dedicated remote control, a model train remote control program operating on a computer (e.g., PC, laptop, tablet, etc.), or a model train remote control application operating on a smart phone (e.g., Apple IPhone™, Samsung Galaxy™, etc.). In either two embodiment, the remote control device is configured to communicate with the model train via a transceiver (see FIG. 1) using a wireless communication protocol, such as WiFi, Bluetooth, Infrared, etc. FIG. 7 shows an example of how metrics may be displayed to a user via a remote control. For example, the remote control 700 may have a coal level 702 and/or a water level 701, which may be displayed to the user via analog gauges or digitally on a display (e.g., an LCD, etc.). It should be appreciated that the present invention is not limited to the gauges shown in FIG. 7, and other ways of informing the user of at least one metric (audio and/or visual) are within the spirit and scope of the present invention.

Figure 8:
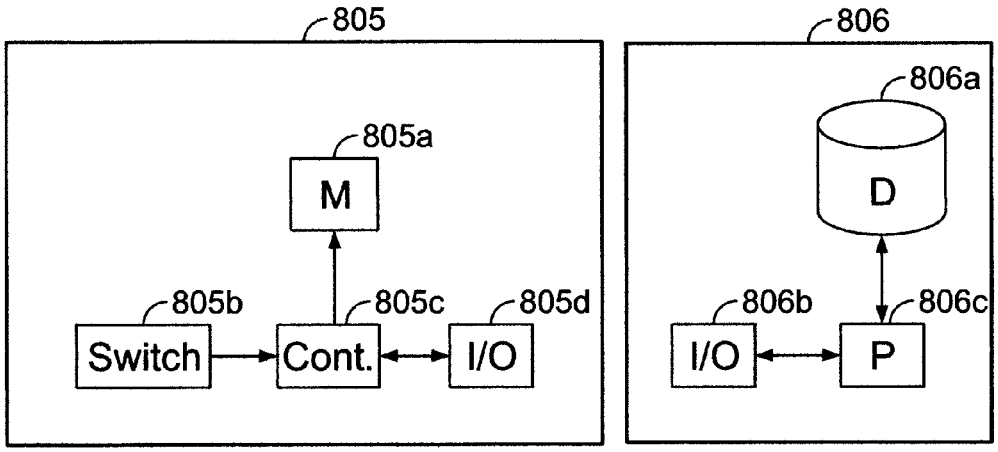
FIG. 8 illustrates one embodiment of the present invention, wherein a first system communicates with a second system disposed within a coal car.

As shown in FIG. 8, a first processor 806*c* may be located in an engine 806 and may be used to monitor at least one metric. This may be done by monitoring various parameters (e.g., train type, train size, train speed, operating time, overall train load (which may be based on the number of cars being pulled by the engine, whether the engine is traveling uphill, whether the engine is traveling downhill, etc.), etc.) and using an algorithm to calculate changes in the metric. For example, if the metric is a coal level, and the known parameters are train type (or size), train speed, and period of time at train speed, then those parameters are ran through an algorithm to calculate how much coal is needed to move an actual train of that type (or size), at that speed, for that period of time. The new coal level (prior coal level minus the calculated value) can be stored in a memory 806*a*, displayed to a user, and provided to the coal car 805 via a transceiver 806*b* (e.g., using a wireless protocol, such as Bluetooth, Infrared, etc.).

A second processor 805*c* located in the coal car 805 receives the new coal level via a transceiver or a receiver 805*d*. If the new coal level is less than the old coal level, then the coal load is moved in a downward direction. Alternatively, if the new coal level is greater than the old coal level, then the coal load is moved in an upward direction. In a preferred embodiment, the vertical position of the coal load is synchronized to the virtual coal level. Thus, if the virtual coal level goes down by 10%, then (at substantially the same time) the coal load is lowered by roughly 10%. Similarly, if the coal level is increased to its maximum level (e.g., during refill), then the coal load is moved to its maximum upward position. As discussed above, at least one switch 805*b* may be used to prevent the load from exceeding its upper and/or lower limits.

Figure 9:
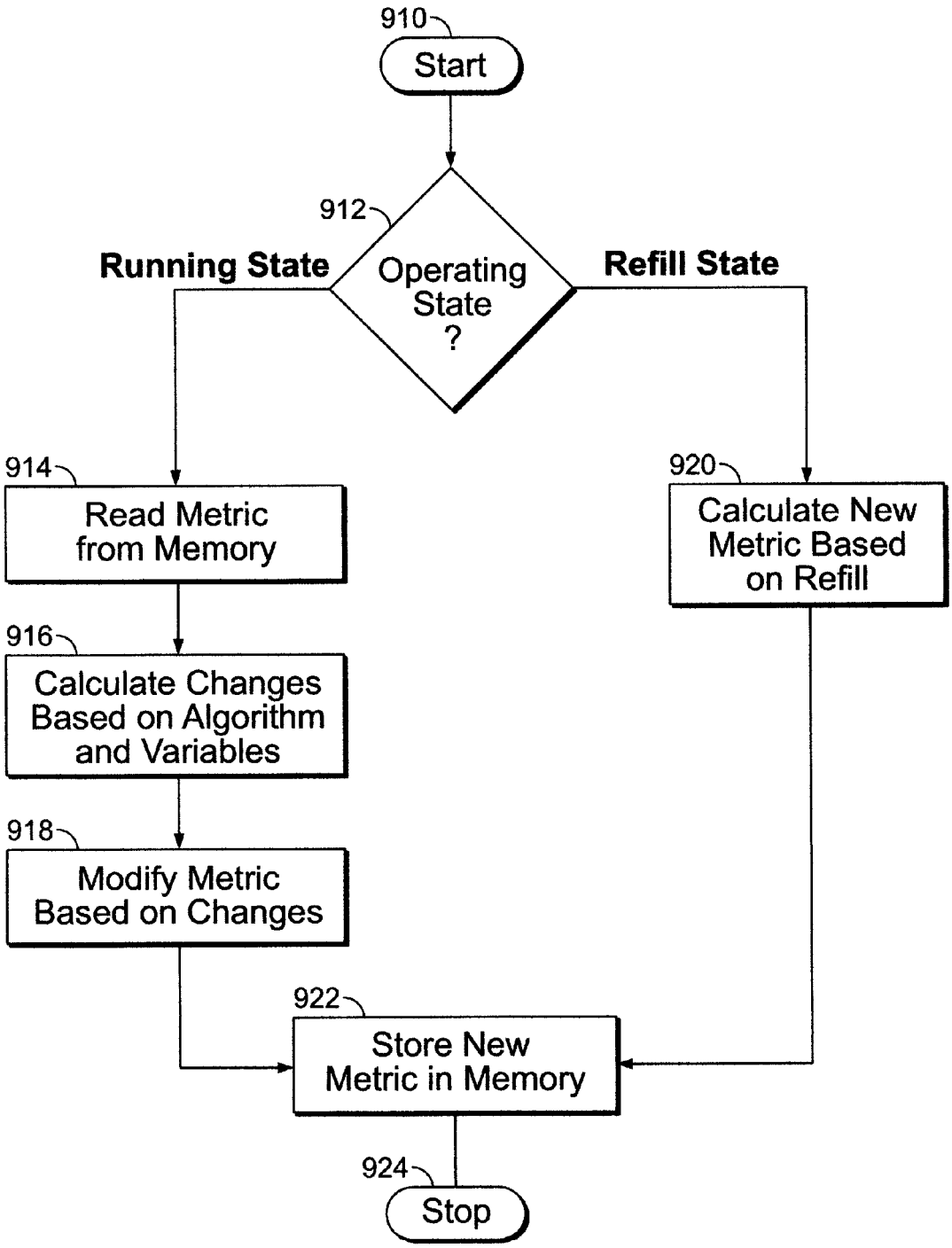
FIG. 9 illustrates a method of updating a metric in accordance with one embodiment of the present invention.

FIG. 9 illustrate a method of monitoring a metric of a model vehicle in accordance with one embodiment of the present invention. The method starts at step 910, where an operating state of the model vehicle is determined at step 912. If the model vehicle is in a refill state (e.g., the user enters a refill command on the remote control, the user pulls the model train into a refill station, etc.), then a new metric (e.g., new coal level) is determined at step 920 (e.g., maximum coal level), and stored in memory at step 922, stopping the method at step 924. If the model vehicle is in a running state, then the current metric (e.g., current coal level) is read from memory at step 914, and changes in the metric are calculated at step 916. As discussed above, the changes can be calculated based on an algorithm and known parameters. The metric (e.g., current coal level) can then be updated (e.g., based on coal consumption) at step 918. The new metric (e.g., new coal level) is then stored in memory at step 922, stopping the method at step 924. It should be appreciated that the present invention is not limited to the method illustrated in FIG. 9, and may include additional, fewer, or differently arranged steps. For example, instead of stopping the method at step 924, the method may loop from step 922 back to step 912.

Figure 10:
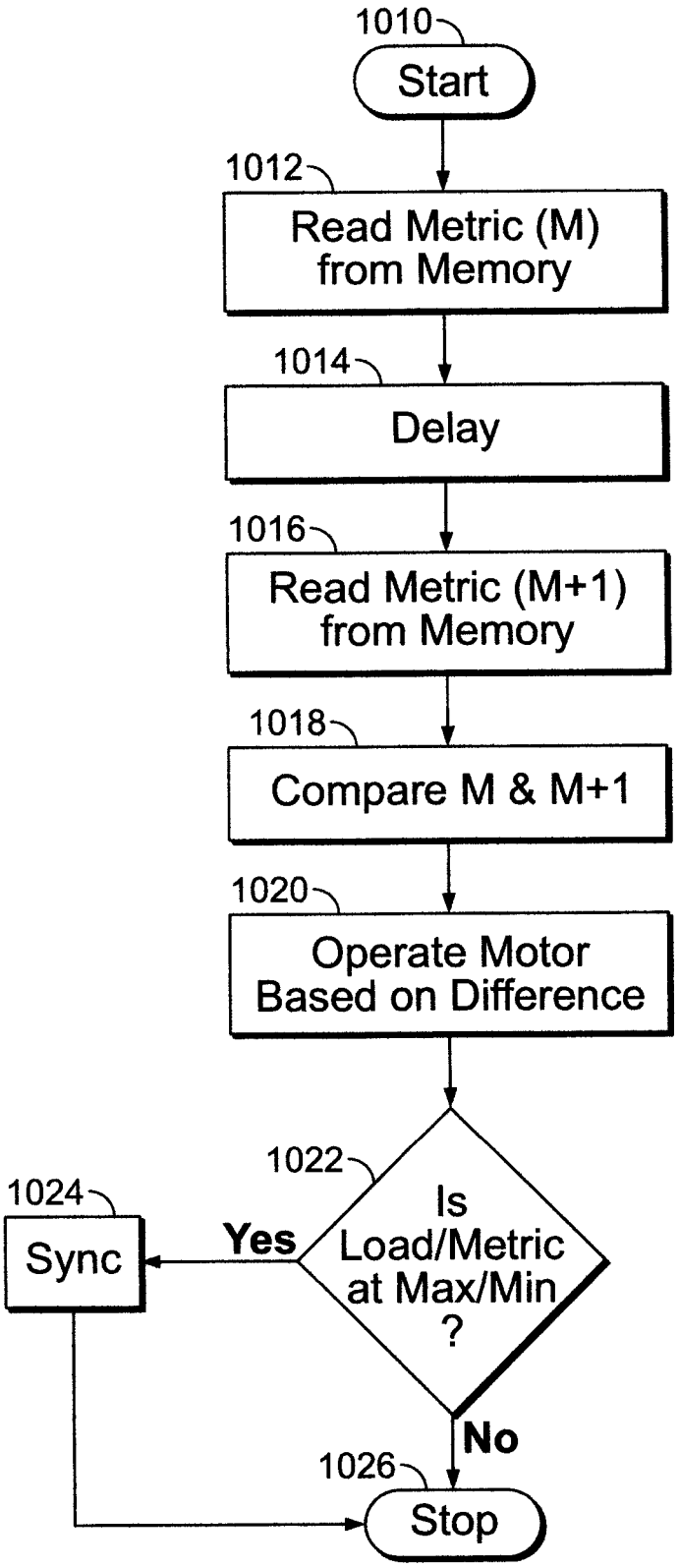
FIG. 10 illustrates a method of synchronizing a load to a metric in accordance with one embodiment of the present invention.

FIG. 10 illustrate a method of synchronizing a load to a virtual metric of a model vehicle in accordance with one embodiment of the present invention. The method starts at step 1010, where a first metric (e.g., current coal level) is read from memory at step 1012. Then, after a delay at step 1014, a new metric (e.g., updated coal level) is read from memory at step 1016. The difference between the new metric (M+1) and the first metric (M) is then calculated at step 1018. The difference is then used to operate the motor at step 1020. If the metric goes up (e.g., coal level goes up), them the load is moved upward, and if the metric goes down (e.g., coal level goes down), then the load is moved downward. Preferably, the speed at which the motor is operated is based on the difference calculated at step 1018 (e.g., the quicker the coal level goes up/down, the faster the motor is operated). This is done to synchronize the vertical position of the coal load to the virtual coal level.

In theory, if the coal load and the virtual coal level are synchronized to start with, and change synchronously, then they should always remain in sync. However, to ensure synchronization, the method may be configured to synchronize the coal load to the virtual coal level when the load is at an upper/lower limit and/or the metric is at a maximum/minimum level. For example, at step 1022 it is determined whether an upper/lower limit and/or maximum/minimum level is reached. If, the answer is NO, the method stops at step 1026. If, however, the answer is YES, the vertical position of the load is synchronized to the level of the metric at step 1024, ending the method at step 1026. For example, if the coal level is refilled (i.e., the coal level is full or at its maximum level), then the motor is operated to move the coal load to its upper limit. Similarly, if the coal level is empty (i.e., the coal level is at its minimum level), then the motor is operated to move the coal load to its tower limit. This way synchronization can be ensured at least when the virtual coal level is full and/or empty. It should be appreciated that the present invention is not limited to the method illustrated in FIG. 10, and may include additional, fewer, or differently arranged steps. For example, instead of stopping the method at step 1026, the method may loop back to step 1012, allowing the coal load to continuously track the virtual coal level. By way of another example, the differences between coal levels (steps 1012, 1014, 1016, and 1018) may be calculated by the first processor, and motor commands can be communicated to the second processor. That way the second processor, which resides in the load car, only needs to process motor commands, such as operate motor in a first direction, operate motor in a second direction, raise the load to its upper limit, lower the load to its lower limit, etc., and does not need to calculate changes in the virtual load level.

Having thus described several embodiments of a system and method for monitoring and/or controlling a load disposed on a model vehicle, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A model vehicle configured to carry a load over a model track, calculate virtual changes to said load, and move said load in a vertical direction, thereby simulating said virtual changes to said load, said model vehicle comprising:

a model vehicle chassis having at least a plurality of walls and a bottom defining a cavity having an upward opening;

at least one axle having at least two wheels configured to interact with said model track;

said load disposed within said cavity of said model vehicle chassis such that a portion of said load protrudes through said upward opening;

a motor on said model vehicle;

means for said load vertically within said cavity while maintaining said load on said model vehicle in response to said motor being operated in first and second directions; and a controller configured to calculate at least one change in at least one virtual metric of said model vehicle and to control said motor in response to said at least one change, said at least one virtual metric being one of a virtual water level and a virtual coal level, said at least one virtual metric changing in response to said model vehicle moving over said model track;

wherein said controller is configured to operate said motor in said first direction in response to said at least one virtual metric decreasing in value and operate said motor in said second direction in response to said at least one virtual metric increasing in value, wherein said load is moved in a downward direction as a result of said at least one virtual metric decreasing in value, moving at least a portion of said load from a position outside said cavity to a position inside said cavity, and said load is moved in an upward direction as a result of said at least one virtual metric increasing in value, moving at least a portion of said load from a position inside said cavity to a position outside said cavity while maintaining said entire load on said model vehicle, and wherein an amount of said movement in said downward direction substantially corresponds to an amount that said at least one virtual metric has decreased in value and an amount of said movement in an upward direction substantially corresponds to an amount that said at least one virtual metric has increased in value.

2. The model vehicle of claim 1, wherein said means comprises a line having a first end connected to said motor and a second end connected to said load.

3. The model vehicle of claim 2, wherein said means further comprises at least one spring having a first end connected said model vehicle chassis and a second end connected to said load, said at least one spring being configured to move said load in an upward direction when said motor is being operated in said second direction.

4. The model vehicle of claim 1, wherein said load comprises one of coal, simulated coal.

5. The model vehicle of claim 1, further comprising a means for preventing said motor from driving said load in a downward direction once said load reaches a predetermined location within said model vehicle chassis.

6. The model vehicle of claim 5, wherein said means allows said motor to operate without further lowering said load.

7. The model vehicle of claim 5, wherein said means comprises at least one limit switch, said controller being configured to turn said motor off and to prevent said motor from operating in said first direction while said limit switch is activated.

8. The model vehicle of claim 1, wherein said controller is configured to calculate said at least one change using at least two of model vehicle size, operating speed, time at said operating speed, and overall model vehicle load.

9. The model vehicle of claim 1, wherein said at least one metric is one of water level and coal level, and said at least one virtual metric is increased in value in response to said model vehicle being moved into a refill state.

10. The model vehicle of claim 9, wherein said controller is further configured to initiate one of a water sound and a coal-dumping sound in response to said model vehicle being moved into said refill state.

11. A method for mechanically moving a load, said load being disposed at least partially within a cavity of a model vehicle having an upward opening, said model vehicle carrying said load over a model track, comprising:

calculating by a controller at least one change in at least one virtual metric of said model vehicle, said at least one virtual metric being one of a virtual water level and a virtual coal level, said at least one virtual metric changing in response to said model vehicle moving over said model track;

operating by said controller a motor in a first direction in response to said at least one virtual metric decreasing in value; and operating by said controller said motor in a second direction in response to said at least one virtual metric increasing in value;

wherein said motor is connected to said load via at least a line having a first end connected to said load and a second end connected to said motor, said motor is used to move said load and said first end of said line in a downward direction in response to said at least one virtual metric decreasing in value, moving at least a portion of said load from a position outside said cavity and protruding through said upward opening to a position inside said cavity, and said motor is used to move said load and said first end of said line in an upward direction in response to said at least one virtual metric increasing in value, moving a least a portion of said load from a position inside said cavity to a position outside said cavity via said upward opening while maintaining said entire load on said model vehicle;

wherein an amount that said load is moved in said downward direction substantially corresponds to an amount that said at least one virtual metric has decreased in value, and an amount that said load is moved in said upward direction substantially corresponds to an amount that said at least one virtual metric has increased in value.

12. The method of claim 11, wherein said step of operating said motor in a first direction in response to said at least one virtual metric decreasing in value further comprises further comprises operating said motor in said first direction while preventing said motor from moving said load beyond a maximum downward direction.

13. The method of claim 11, wherein said step of operating said motor in a first direction in response to said at least one virtual metric decreasing in value further comprises using at least one limit switch to prevent said motor from moving said load beyond a maximum downward direction.

14. The method of claim 11, further comprising using calculations to determine at least one value associated with said at least one virtual metric, said calculations taking into consideration at least two of a size of said model vehicle, a speed of said model vehicle, a time that said model vehicle operates at said speed, and an overall load of said model vehicle.

15. The method of claim 11, further comprising increasing said at least one virtual metric in response to a user moving said model vehicle into a refill state.

16. The method of claim 15, further comprising playing one of a water sound and a coal-dumping sound in response to said model vehicle being moved into said refill state.

17. A model vehicle configured for propulsion over a model track, calculating virtual changes corresponding to a load of said model vehicle, and moving said load in a vertical direction in response to said virtual changes, comprising:

a load disposed partially within a cavity of a model vehicle chassis having at least a plurality of walls and a bottom and configured to be moved in two directions, said cavity having an upward opening, said load protruding partially through said upward opening;

a motor;

means for moving said load vertically within said cavity while maintaining said load on said model vehicle in response to said motor being operated in first and second directions; and a controller configured to calculate changes in a virtual metric of said model vehicle and to control said load via said motor in response to said changes in said virtual metric, said virtual metric being one of a virtual coal level and a virtual water level, said virtual metric changing in response to said model vehicle being propelled over said model track;

wherein said controller is configured to operate said motor in a first direction in response to said virtual metric decreasing in value and operate said motor in a second direction in response to said virtual metric increasing in value, wherein said load is moved in a downward direction as a result of said virtual metric decreasing in value, lowering said load into said cavity a distance that substantially corresponds to an amount that said virtual metric has decreased in value, and said load is moved in an upward direction as a result of said virtual metric increasing in value, raising said load through said upward opening and out of said cavity a distance that substantially corresponds to an amount that said metric has increased in value.

18. The model vehicle of claim 17, wherein said means comprises a line having a first end connected to said motor and a second end connected to said load.

19. The model vehicle of claim 18, wherein said means further comprises at least one spring, said at least one spring being configured to move said load in an upward direction when said motor is being operated in said second direction.

20. The model vehicle of claim 17, further comprising a device for preventing said motor from driving said load in a downward direction once said load reaches a maximum lower limit, said device being one of a clutch and a limit switch.

* * * * *